US005504954A

United States Patent [19]

Joo et al.

[11] Patent Number: 5,504,954

[45] Date of Patent: Apr. 9, 1996

[54] WASHING METHOD FOR WASHING CLOTHES MADE OF WOOL OR SILK

[75] Inventors: Haeng D. Joo; Bok N. Song, both of Seoul, Rep. of Korea

[73] Assignee: Daewoo Electronics Co., Ltd., Rep. of Korea

[21] Appl. No.: 295,027

[22] Filed: Aug. 25, 1994

[30] Foreign Application Priority Data

Aug. 27, 1993 [KR] Rep. of Korea ..... 93-16880
Oct. 30, 1993 [KR] Rep. of Korea ..... 93-22895

[51] Int. Cl.[6] ..... D06F 33/02; D06F 39/08

[52] U.S. Cl. ..... 8/158; 8/159; 68/12.05; 68/12.12; 68/12.18; 68/12.19

[58] Field of Search ..... 8/158, 159; 68/12.05, 68/12.12, 12.18, 12.19, 207, 12.21

[56] References Cited

U.S. PATENT DOCUMENTS

| | | | |
|---|---|---|---|
| 3,470,718 | 10/1969 | Scourtas et al. | 68/12.21 |
| 3,589,148 | 6/1971 | Wasemann | 68/12.01 |
| 4,503,575 | 3/1985 | Knoop et al. | 8/158 |
| 4,995,247 | 2/1991 | Ishino et al. | 68/12.18 |

FOREIGN PATENT DOCUMENTS 293615 9/1991 Germany .

*Primary Examiner*—Philip R. Coe
*Attorney, Agent, or Firm*—Beveridge, DeGrandi, Weilacher & Young

[57] ABSTRACT

A washing method capable of washing the laundry made of a fabric which is thin and shrinkable such as silks, wools, etc., simply at home without damaging the delicate fabrics and washing machine which is suitable for carrying out the above washing method. A detergent is introduced into a washing tank equipped with a rotary blade for generating a water stream and then a first amount of water suitable for diluting the detergent is introduced into the washing tank. Then, while rotating the rotary blade to generate a first water stream in the first amount of water, water is continuously introduced into the washing tank, so that the detergent is diluted in the first amount of water and that the washing tank is filled with a second amount of water suitable for washing the washing object. Then, the washing object is introduced into the washing tank with the second amount of water and then the washing object is washed by rotating the rotary blade for generating a second water stream suitable for washing the washing object. The rotation time of the rotary blade in the washing and rinsing steps is adjusted in accordance with the material of the washing object, so a water stream suitable for the washing object is generated in the washing and rinsing steps. A dry cleaning washing and silk washing courses can be simply performed at home without any damages to the laundry.

20 Claims, 4 Drawing Sheets

WASHING METHOD FOR WASHING CLOTHES MADE OF WOOL OR SILK

BACKGROUND OF THE INVENTION

1. Field of the Invention

The present invention relates to a method of washing clothes and a washing machine. More particularly, the present invention relates to a washing method and a washing machine capable of performing the washing method wherein a dry-cleaning course for a washing object is performed by controlling a rotation speed of a rotary blade and water stream time and also a washing object made of delicate fabrics such as silk or wools can be washed clean without any damages.

2. Prior Arts

In general, in a fully automatic washing machine, washing the laundry is performed by sequentially performing washing, rinsing, draining and dewatering operations in accordance with predetermined programs which are installed therein. FIG. 1 is a block diagram showing a construction of a fully automatic washing machine. As shown in FIG. 1, the conventional fully automatic washing machine has a key array part 12 for generating washing order signals in accordance with a user's selection, a microcomputer (hereinafter, often referred to as "micom") 10 for generating control signals for performing various operations in accordance with the user's order signals, a driving part 16 for driving various parts pursuant to the control signals from micom 10 and a display part 14 for displaying the user's instructions and the operation status of the washing machine.

When washing the laundry by using the conventional fully automatic washing machine, firstly the user switches on the washing machine, selects a washing process which he wants, and then inputs this from key array part 12 so that the washing machine performs the washing process. Thereafter, the laundry is introduced into a washing tank and then a detergent is introduced into the washing tank in an amount suitable for the laundry. The detergent can be introduced into the washing tank manually or automatically by micom 10. At the bottom of the washing tank, a rotary blade for generating a water stream is provided. Washing water is supplied into the washing tank through a water introducing pipe while rotating the rotary blade at a low speed or at a stationary state of the rotary blade. With rotating the rotary blade at a low speed, water and the laundry can be mingled together before the washing process. When a predetermined amount of water suitable for the laundry is introduced into the washing tank, a sensor senses this and sends a washing start signal to micom 10. Then, micom 10 sends a water introducing stop signal to driving part 16, which closes a water introducing valve to stop the water introduction. In this way, a proper amount of water is introduced into the washing tank automatically.

When the supply of the water is completed, micom 10 sends a washing order signal to driving part 16, which drives a motor so that the rotary blade may rotate to generate the water stream during a predetermined time. Thus, the laundry is washed. At this time, the driving part drives the rotary blade to rotate right and left during a predetermined time to thereby generate a rotating water stream in the washing tank. Due to the rotating friction force of the rotating water stream, detergent detaches the stains or contaminants stuck to the laundry, i.e., the laundry is washed. The stains or contaminants remain in the washing tank in a colloid state with the mixed detergent.

When the washing process is completed, micom 10 sends a washing stop signal to driving part 10 to stop the rotary blade and to open a water drain valve. Then, the washing water in the washing tank is drained through a drain hose. When the water is completely drained, micom 10 senses it and closes the water drain valve.

Thereafter, through the water introducing pipe, a new washing water is introduced into the washing tank. The rotary blade is rotated in the same manner as in the washing process during a predetermined time to thereby accomplish rinsing of the laundry. When the predetermined time expires, the rotary blade stops and the water drain valve is opened again to drain the water which has rinsed the laundry through the drain hose. These water introducing—rotating—draining processes are repeated two or three times in general, to thereby separate stains and/or contaminants attached to the laundry from the laundry completely. This process is referred to as a rinsing process.

Next, a dewatering process is performed. When the washing water in the rinsing process is completely drained through the drain valve, micom 10 sends a dewatering signal to driving part 16 to rotate the washing tank which is combined with the rotary blade by a mechanical mechanism in one direction at a high speed during the predetermined time. The washing water absorbed in the laundry is dewatered by a centrifugal force generated by the above high speed rotation, In this manner, the washing of the laundry is completed.

In the above conventional fully automatic washing machines mentioned, the rotation speed of the rotary blade during the washing and rinsing processes and that of the washing tank during the dewatering process is previously determined at such a degree that the general laundry is not damaged. Accordingly, when washing the laundry made of a fabric which is thin and has a high shrinkage degree such silk or pure wool using the conventional washing machine, the centrifugal force generated by the rotation of the rotary blade during the washing and rinsing processes and the centrifugal force generated by the rotation of the washing tank during the dewatering process are so strong that the fabrics are extremely damaged by the rotary blade and the washing tank and become shrunk much. Therefore, when one wishes to wash the laundry made of these fabrics, he entrusts the laundry shop for washing the laundry where a particular detergent and solvent are suitably used for silks or wools. However, such a detergent and solvent is expensive and laundry charges include the labor cost, so the cost for the laundry becomes high. Further, in the laundry shop, they accumulate several laundries from different persons and wash them at one time. Therefore, someone may regard this as being unsanitary.

SUMMARY OF THE INVENTION

Accordingly, it is an object of the present invention to provide a washing method capable of washing the laundry made of a fabric which is thin and shrinkable such as silks, wools, etc., simply at home without damaging the delicate fabrics, thereby relieving the burden of the laundry charges and eliminating the prejudice of the unsanitation in relation to the laundry entrusted to,the laundry shop so that one may wear the clothes with a clear and a comfortable mind.

To accomplish the above object of the present invention, there is provided a method for washing a washing object comprising the steps of:

introducing a detergent into a washing tank equipped with a rotary blade for generating a water stream;

introducing a first amount of water into the washing tank;

introducing additional water into the washing tank while generating a first water stream in the first amount of water by driving the rotary blade, so that the detergent is diluted in the first amount of water and that the washing tank is filled with a second amount of water suitable for washing the washing object; the second amount of water containing the detergent;

introducing the washing object into the washing tank with the second amount of water; and washing the washing object by rotating the rotary blade for generating a second water stream suitable for washing the washing object.

After the washing step, a rinsing step of the washing object is performed by performing a rinsing process at least once. The rinsing process comprises the steps of:

a) draining a remaining water from the washing tank; and after the washing step or a previous rinsing step;

b) introducing a third amount of water suitable for rinsing the washing object into the washing tank; and c) rinsing the washing object by generating a third water stream suitable for rinsing the washing object.

After the rinsing step, a remaining water is drained from the washing tank; and then a remaining water absorbed in the washing object is dewatered by rotating the washing tank.

In accordance with the above method, the washing object made of wool or silk can be washed. The rotation time of the rotary blade in the washing and rinsing steps is adjusted in accordance with the material of the washing object, so a water stream suitable for the washing object is generated.

Further, the present invention may be carried out using a washing machine for washing a washing object comprising:

a washing tank for containing a water, a washing object and a detergent;

a means for introducing a water into the washing tank;

a means for draining a water from the washing tank;

a rotary blade in the washing tank for generating a water stream;

a driving motor for transmitting a driving force to the washing tank and the rotary blade;

a driving part for operating the driving motor, the water introducing means and the water draining means;

a sensor for generating a first signal by sensing a first amount of water suitable far diluting a detergent, a second signal by sensing a second amount of water suitable for washing a washing object, and a third signal by sensing a completion of water draining;

a microcomputer for generating a water introducing signal for controlling the water introducing means which is transmitted to the driving part so that water may be introduced according to a user's order, a first rotation order signal for rotating the rotary blade in order to dilute the detergent which is transmitted to the driving part according to the first signal, a second rotation order signal for rotating the rotary blade to perform the steps of washing and rinsing the washing object which is transmitted to the driving part according to the second signal, a water drain signal for controlling the drain means in order to drain a water from the washing tank when a washing step or a rinsing step is finished which is transmitted to the driving part, and a washing or dewatering order signal for washing or dewatering the washing object according to the third signal.

Preferably, the washing machine includes a display part for displaying a general mode for performing a washing process for washing a washing object comprised of a cotton or a synthetic fiber, a silk mode for washing a washing object comprised of a silk and/or a dry mode for washing a washing object comprised of a wool according to a user's selection.

In accordance with the present invention, a rotating water stream which does not damage the washing object is generated in the washing and rinsing steps by considering the fabrics constituting the washing object. Therefore, a dry cleaning washing and silk washing courses can be simply performed at home without any damages to the laundry.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Hereinafter, the present invention will be explained in details with reference to the accompanying drawing.

Figure 1:
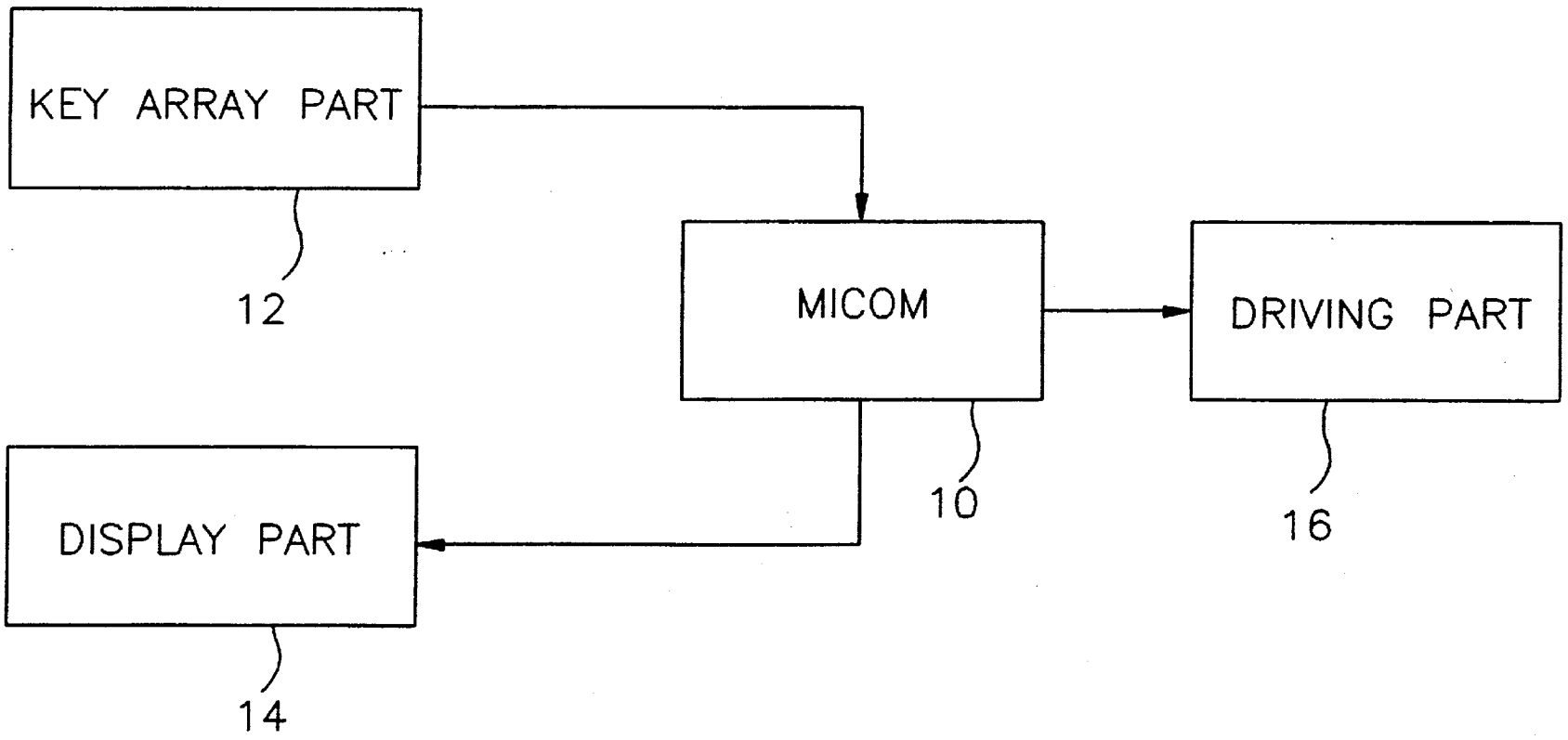
FIG. 1 (PRIOR ART)
FIG. 1 is a block diagram showing a construction of a fully automatic washing machine.
Figure 2A:
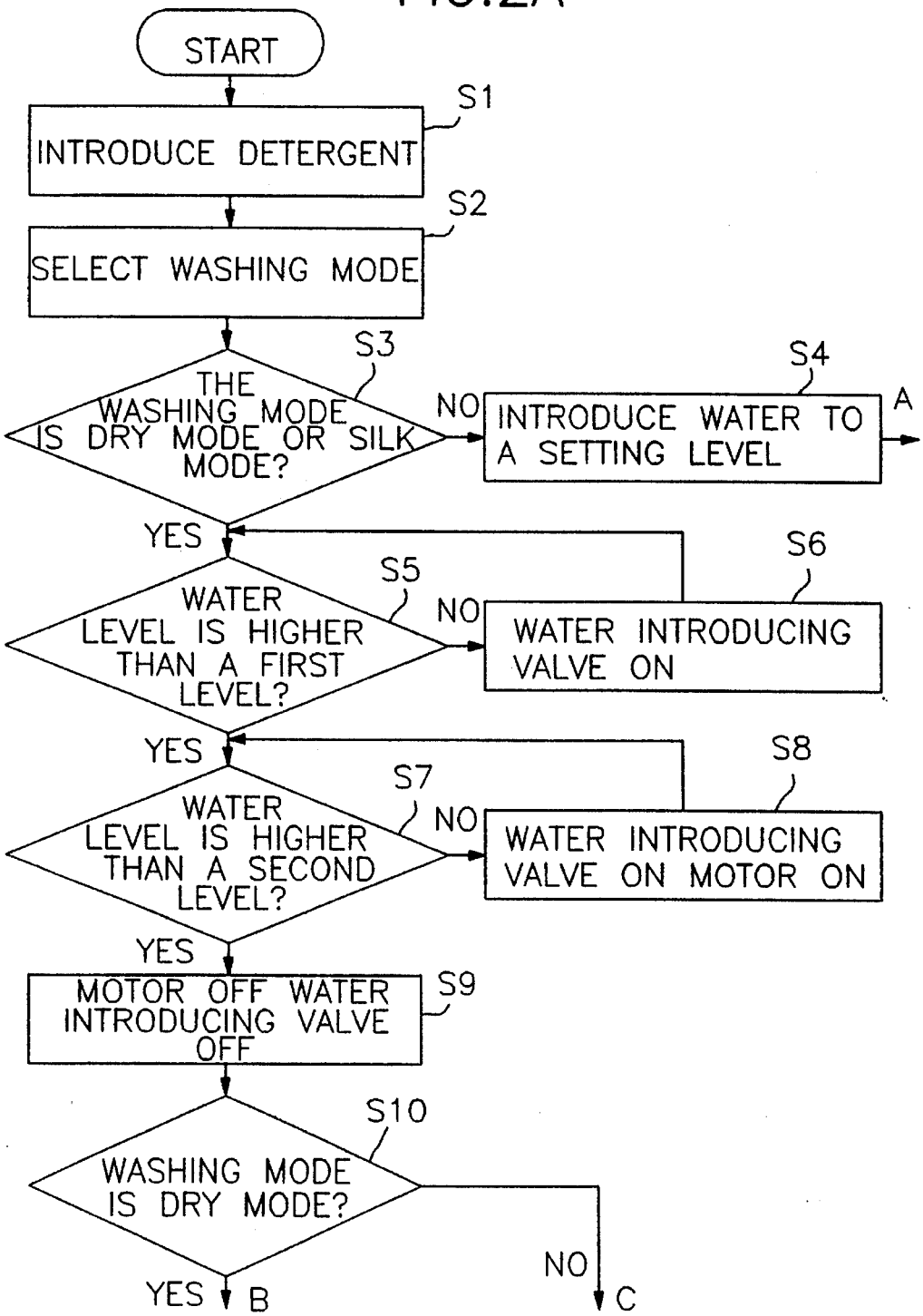
FIGS. 2A and 2B are a flow chart for schematically illustrating a washing method in accordance with one embodiment of the present invention.
Figure 2B:
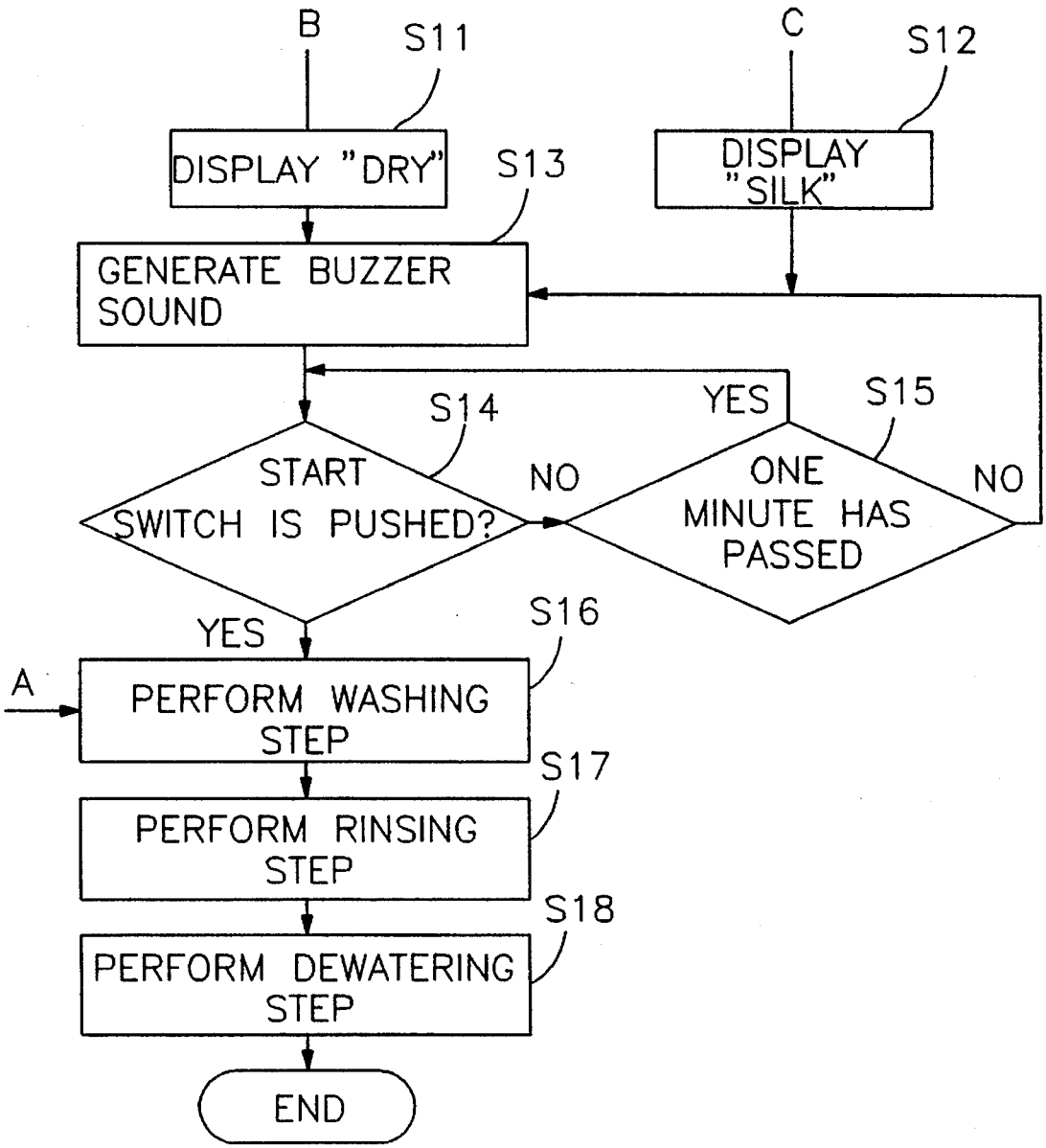
Figure 3:
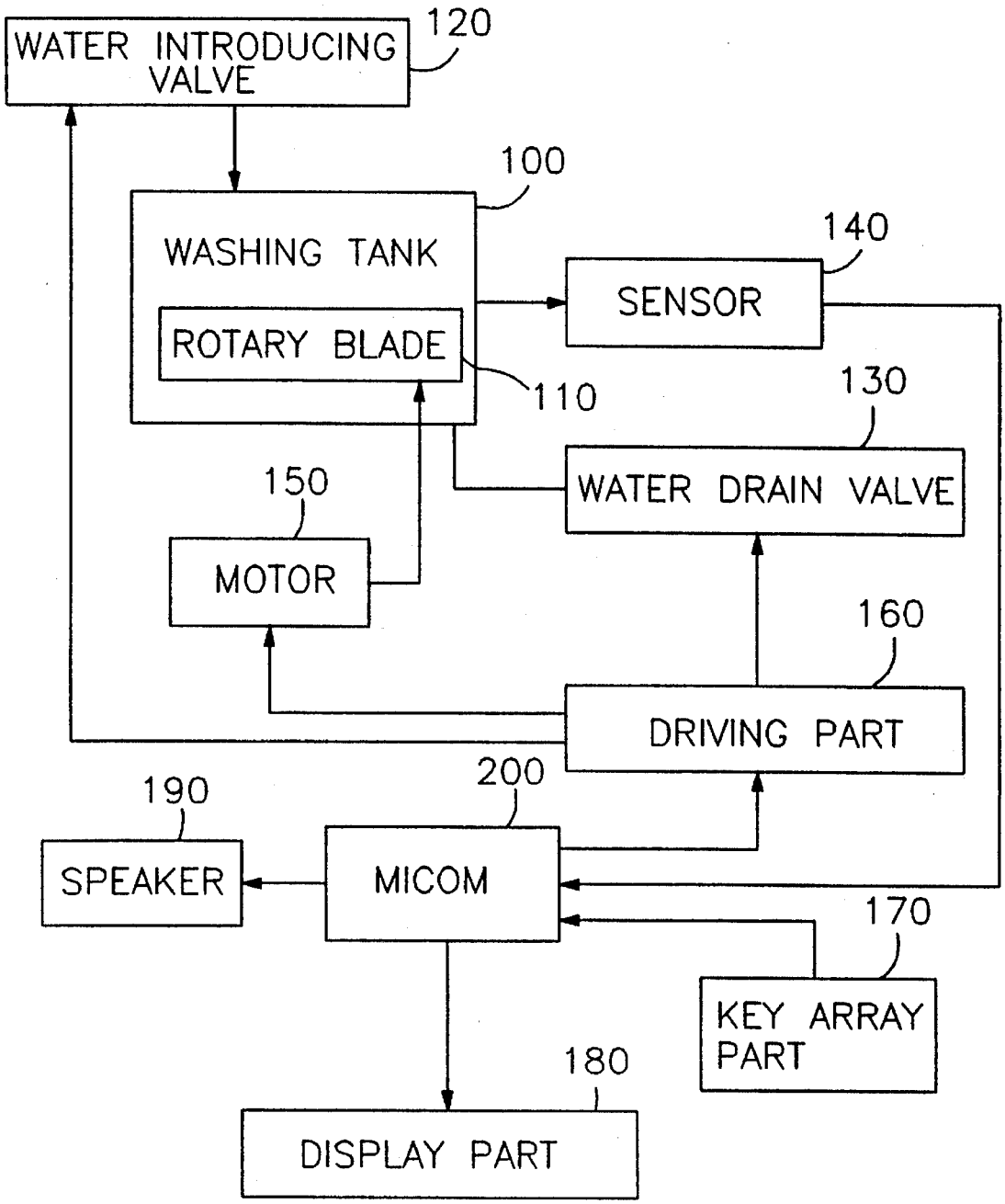
FIG. 3 is a block diagram showing a construction of a washing machine according to one embodiment of the present invention for carrying out a method of the present invention.

FIGS. 2A and 2B are a flow chart for schematically illustrating a washing method in accordance with one embodiment of the present invention and FIG. 3 is a block diagram showing a construction of a washing machine for carrying out a method of the present invention.

Referring to FIGS. 2A and 2B and 3, a washing method and a washing machine will be explained in detail as follows. As shown in FIG. 3, the washing machine according to one embodiment of the present invention has a washing tank 100 for receiving a detergent and the laundry as a washing object and performing a washing process for the laundry, a rotary blade provided at a bottom portion of washing tank for generating a water stream, a water introducing valve 120 for controlling the water introduction into washing tank 100, a water drain valve 130 for draining water from washing tank 100, a sensor 140 for sensing the water level and a load in washing tank 100, a motor 150 for driving rotary blade 110, a driving part 160 for driving motor 150, water introducing valve 120 and water drain valve 130, a key array part 170 for inputting a user's selection mode, a display part 180 for displaying the status of the washing machine and the user's selection mode, a speaker 190 for generating a buzzer sound and a micom 200 provided with program for receiving user's instructions from key array part 170 and then generating control signals for controlling driving part 160, display part 180 and speaker 190.

At first, the user prepares the laundry, considers whether he should perform a general course washing for washing a general washing object made of cotton, synthetic fabric, etc., dry cleaning course washing for washing a washing object made of a pure wool or a silk course washing for washing a washing object made of silk and then determines a washing mode of a washing machine in accordance with the kinds of laundry. Then, the power of the washing machine is switched on.

A detergent is introduced in an amount suitable for washing the laundry ($S_1$). At this time, water introducing valve 120 and water drain valve 130 are in a closed state. When performing a dry cleaning course washing or silk course washing, a detergent essentially consisting of lauryl alkyloxyethylene, alkanolamide, normal paraffins and limonene which are particularly suitable for the dry cleaning course and silk course washing (which is different from those for a general washing course and from those used in the laundry shop) is preferably used. The detergent is preferably used in an amount of 0.5 g per liter of washing water. After introducing the detergent into washing tank 100, a desired washing mode selected among a dry mode for performing the dry cleaning washing course and a silk mode for performing the silk washing course is inputted through key array part 170 ($S_2$). When any washing mode is not inputted until a predetermined period passes, micom 200 regards the washing mode as a general mode for performing a general washing course ($S_3$). In a case of a general washing course, after introducing washing water to a set water level ($S_4$), a general washing process comprised of a washing step ($S_{16}$), a rinsing step ($S_{17}$) and a dewatering step ($S_{18}$) is performed. This general washing process is the same as that performed in a conventional washing machine. At this time, the laundry is introduced into washing tank 100 before or after introducing the detergent.

When micom judges that the washing mode is a dry mode or a silk mode ($S_3$), sensor 140 senses the present water level of the washing water in washing tank 100. When the sensed water level does not reach a predetermined level (first level; for example about 40%–60% of the water level suitable for washing the washing object) suitable for diluting the detergent (that is, the water level is not enough for the dilution of the detergent) ($S_5$), micom 200 sends a water introducing order signal to driving part 160 to open water introducing valve 120 so that washing water is introduced into washing tank through a water introducing pipe ($S_6$). This is referred to as a first water introducing step. In the above description, the detergent has been introduced before the first water introducing stage. However, the detergent may be introduced into washing tank 100 during the first introducing step. The detergent is diluted with a first amount of washing water less than the amount of washing water suitable for performing the washing step of the washing object. In this manner, the washing ability of the detergent is improved.

When the sensed water level is higher than a predetermined water level suitable for diluting the detergent, micom 200 judges whether the sensed water level is a predetermined water level (a second water level) suitable for washing the washing object ($S_7$). The water level suitable for washing the washing object depends on the amount of the washing object. For example, when the amount of the washing object is not more than about 2 kg, the water level is determined such that the amount of the washing water in washing tank 100 is about 50 liters. When the amounts of the washing object are not more than about 4 kg and about 5 kg–9 kg, the water levels are determined such that the amounts of the washing water in washing tank 100 are about 80 liters and 93 liters, respectively. The concentration of the detergent in the washing water is about 0.5 g/liter. When the sensed water level is deficient in washing the washing object, micom 200 opens water introducing value 120 through driving part 160 to continuously introduce water into washing tank 100. Simultaneously, micom 200 sends a rotation order signal to driving part 160 to thereby drive motor 150 ($S_8$). The driving force of motor 150 is transferred to rotary blade 110 in washing tank 100 so that rotatory blade 110 rotates to generate a water stream in,the washing water in washing tank 100. Due to the water stream, the detergent is mixed with the washing water so that the detergent is diluted with the washing water before the washing step.

The washing water is continuously introduced into washing tank 100 and sensor 140 senses the water level and sends signals to micom 200. Within a predetermined time, sensor 140 senses a water lever enough for performing the washing step of the washing object. When micom 200 judges that the water level in washing tank 100 is suitable for performing the washing the laundry ($S_7$), micom 200 sends a water introducing stop order signal and a motor rotation stop order signal to driving part 160. Driving part 160 closes water introducing valve 120 in accordance with the water introducing stop order signal and stops motor 150 so that rotary blade 100 does not rotate any more ($S_9$).

Then, micom judges whether the washing mode is a dry mode or a silk mode ($S_{10}$). When the washing mode is dry mode, micom 200 sends a display signal to display part 180 so that display part 180 displays "dry" ($S_{11}$). When the washing mode is not a dry mode, that is, the washing mode is a silk mode, micom 200 send a display signal to display part 180 so that display part 180 displays "silk" ($S_{12}$). Then, the user sees the displayed mode and remembers the firstly determined mode so that the user may introduce an adequate washing object correctly into washing tank 100.

Then, micom 200 sends a buzzer sound generating signal to speaker 190 to generate a buzzer sound on speaker 190 ($S_{13}$). When the user hears the buzzer sound, he introduces the laundry into washing tank 100 and then pushes a start button in key array part 170. The start button generates a start signal which is transmitted to micom 200 to start a washing process. Within a predetermined time, for example, within one minute, when the start signal is not inputted in micom 200 from key array part 170, micom 200 sends a buzzer sound generating signal to speaker 190 again to generate another buzzer sound ($S_{15}$).

In accordance with the start signal, micom 200 sequentially sends a control signal for performing a washing step to driving part 160 to thereby control each system of the washing machine wholly. Motor 150 is driven via driving part 160. The driving force of motor 150 rotates rotary blade 100 to generate a water stream suitable for washing the laundry, to wash them ($S_{16}$).

When the washing object is comprised of a wool and therefore, the washing mode is a dry mode, micom 200 sends a control signal to driving part 160 so that rotary blade 110 may rotate right as in a first direction for about 2–4 seconds, be stationary for about 5–6 seconds, rotate left as in a second direction opposing to the first direction for about 2–4 seconds and then be stationary for about 5–6 seconds. This process including the above operations as one cycle is repeated continuously for about six minutes. Here, the ratio of water stream strength of the dry mode with respect to the general mode is about 0.24 to 0.34, preferably about 0.27 to 0.31.

When the washing object is comprised of a silk and therefore, the washing mode is a silk mode, micom 200 sends a control signal to driving part 160 so that rotary blade 110 may rotate right as in a first direction for about 0.3–0.5 seconds, be stationary for about 5–6 seconds, rotate left as in a second direction opposing to the first direction for about 0.3–0.5 seconds and then be stationary for about 5–6 seconds. This process including the above operations as one cycle is repeated continuously for about four minutes. Here, the ratio of water stream strength of the silk mode with respect to the general mode is about 0.06 to 0.11, preferably about 0.07 to 0.09.

When the washing step is completed, micom 200 sends a water drain order signal to driving part 160, which opens water drain valve 130 to drain the washing water from washing tank 100 through a drain hose. At this time, rotary blade 110 is in a stationary state.

When the water draining is completed, sensor 140 senses the water level and sends the sensed water level to micom 200. Micom 200 performs a rinsing step through driving part 160 ($S_{17}$). At first, micom 200 sends a water introducing order signal to driving part 160. Then, water drain valve 130 is closed and water introducing valve 120 is opened to thereby introduce a new washing water into washing tank 100 which is suitable for rinsing the washing object. When the water introduction is finished, water introducing valve 120 is closed and motor 150 is driven to generate a water stream suitable for rinsing the washing object.

The water stream necessary for the rinsing step is generated in the same manner as in the washing step. That is, when the washing mode is a dry mode, rotary blade 110 rotates right as in a first direction for about 2–4 seconds, is stationary for about 5–6 seconds, rotates left as in a second direction opposing to the first direction for about 2–4 seconds and then is stationary for about 5–6 seconds, which as one cycle is repeated continuously for about two minutes. When the washing mode is a silk,mode, rotary blade 110 rotates right as in a first direction for about 0.3–0.5 seconds, is stationary for about 5–6 seconds, rotates left as in a second direction opposing to the first direction for about 0.3–0.5 seconds and then is stationary for about 5–6 seconds, which as one cycle is repeated continuously for about one to three minutes, preferably about two minutes. After generating the water steam for the rinsing step for a predetermined time, the rotation of rotary blade 110 is stopped and then water drain valve 130 is opened to separate contaminants suspended in the washing water from the washing object. This rinsing step is performed at least once, preferably twice so that contaminants remaining on the washing object are removed.

When the rinsing step is completed and all the washing water remaining in washing tank 100 is drained, micom 200 combines rotary blade 100 with washing tank 100 mechanically and then drives motor 150 to rotate washing tank at a high speed. Then, the water absorbed in the washing object is dewatered ($S_{18}$). While the rotation speed of washing tank 100 in a general mode is about 760 r.p.m., that in the dry or silk mode is about 100 to 150 r.p.m.

The above dewatering step in both dry and silk modes is performed by rotating washing tank 100 in a first direction for about 3–5 seconds, stilling washing tank 100 for about 5–6 seconds, repeating at least once, preferably about seven times a process comprising the steps of i)rotating washing tank 100 in a first direction for about 2–3 seconds and ii) stilling washing tank 100 for about 5–6 seconds, and then rotating washing tank 100 in a first direction for about 2–3 seconds.

When the dewatering step is completed to finish the washing of the washing object, micom 200 generates a buzzer sound via speaker 190 so that the user may note that.

The above washing method of the present invention can be automatically performed by using a washing machine according to the present invention.

Hereinafter, the present invention will be explained in more details with reference to the following embodiment.

Embodiment 1

The present embodiment illustrates a general washing method for washing a general washing object made of cottons or synthetic fabrics.

After introducing a detergent ($S_1$) and the laundry into washing tank 100, the power of the washing machine is switched on. Micom 200 waits for a signal for selecting a washing mode to be inputted. When any washing mode is not inputted until a predetermined period passes, micom 200 regards the washing mode as a general mode for performing a general washing course ($S_3$). Micom 200 sends a water introducing order signal to driving part 160 to open water introducing valve 120 so that washing water is introduced into washing tank through a water introducing pipe to a set level ($S_4$). During the water introducing step, micom 200 rotates rotary blade slightly so that the detergent is mixed uniformly before performing a washing step. In this manner, the washing ability of the detergent is improved.

Micom 200 senses via sensor 140 whether the sensed water level is a predetermined water level suitable for washing the washing object so that a suitable amount of water may be introduced into washing tank 100.

When the water introduction is finished, micom 200 sends a washing order signal to driving part 160 so that rotary blade 110 may rotate right and left. Due to the centrifugal force of rotary blade 110, the water stream in the washing water is generated to thereby wash the laundry by the rotation friction of the water stream ($S_{16}$). This is the same as in a general washing process in a conventional washing machine.

When the washing step is completed, water drain valve 130 is opened to drain the washing water from washing tank 100 through a drain horse. When the water draining is completed, water drain valve 130 is closed and micom 200 sends a rinsing order signal to driving part 160.

Then, water introducing valve 120 is opened to thereby introduce a new washing water into washing tank 100 which is suitable for rinsing the washing object. When the water introduction is finished, water introducing valve 120 is closed and rotary blade is rotated right and left in a predetermined time to generate a water stream suitable for rinsing the washing object. This rinsing step is performed twice so that contaminants remaining on the washing object are cleanly removed ($S_{17}$).

When the rinsing step is completed and all the washing water remaining in washing tank 100 is drained, a dewatering step is performed. In the dewatering step, with water drain valve 130 opened, micom 200 combines rotary blade 100 with washing tank 100 mechanically via driving part 160 and then drives motor 150 connected to driving part 160 to rotate washing tank 100 at a high speed. Then the water absorbed in the washing object is dewatered due to the centrifugal force of washing tank 100. Thus, the washing of the washing object is completed ($S_{18}$).

Embodiment 2

The present embodiment illustrates a dry cleaning washing method for washing a washing object made of a pure wool.

A detergent suitable for dry cleaning is introduced in an amount suitable for washing the laundry ($S_1$) and then a button for selecting a dry mode in key array part 170 is pushed ($S_2$). When micom 200 receives the signal for selecting the dry mode from key array part 170, a method for performing a dry cleaning washing course is performed to wash the laundry.

More particularly, in a selecting step of the washing mode, key array part 170 send a dry mode selection signal to micom 200 ($S_3$), which judges whether the water level reaches the first level ($S_5$) and sends a water introducing order signal to driving part 160 to open water introducing valve 120 ($S_6$). Then, washing water is introduced into washing tank 100 in a small amount through water introducing pipe.

When the suitable amount of water for diluting the detergent is introduced, micom 200 drives motor 150 via driving part 160 for a predetermined time, to thereby rotate rotary blade 110 at a low rotation speed. Due to the rotation of rotary blade 110, a water stream is generated to dilute the detergent. Simultaneously, a predetermined amount of water is sequentially introduced into washing tank 100 ($S_8$).

When the suitable amount of water (at this time, the concentration of the detergent is about 0.5 g/l) is introduced into washing tank ($S_7$) and the dilution of the detergent is completed, sensor 140 senses a water level enough for performing the washing step of the washing object and sends a signal to micom 200. Then, micom 200 sends a water introducing stop order signal and a motor rotation stop order signal to driving part 160 ($S_9$). Driving part 160 closes water introducing valve 120 in accordance with the water introducing stop order signal and stops motor 150 so that rotary blade 100 does not rotate any more. Also, micom 200 judges that the washing mode is a dry mode ($S_{10}$), and sends a display signal to display part 180 so that display part 180 displays "dry" ($S_{11}$) and sends a buzzer sound generating signal to speaker 190 to generate a buzzer sound on speaker 190 ($S_{13}$). When the user hears the buzzer sound, he introduces the laundry into washing tank 100 and then pushes a start button in key array part 170. Micom 200 judges whether the start signal is inputted from key array part 170 ($S_{14}$). When micom 200 senses the start signal, a signal for performing the washing step is transmitted to driving part 160 to start the dry cleaning washing course. Within one minute, when the start signal is not inputted in micom 200 from key array part 170, micom 200 sends a buzzer sound generating signal to speaker 190 again to generate another buzzer sound ($S_{15}$).

At the state that the washing object is in washing tank 100, when the start signal is applied, driving part 160 drives motor 150 so that rotary blade 110 rotates right and left for a predetermined time. More particularly, rotary blade 110 rotates in the right direction for about 2–4 seconds, is stationary for about 5–6 seconds, rotates in the left direction for about 2–4 seconds and then is stationary for about 5–6 seconds, which as one cycle is repeated for a predetermined time (for example, about six minutes) to wash the washing object ($S_{16}$).

When the washing step is completed, micom 200 sends a water drain order signal to driving part 160, which opens water drain valve 130 to drain the washing water from washing tank 100 through a drain horse.

When the water draining is completed, micom 200 sends a water introducing order signal to driving part 160. Then, water drain valve 130 is closed and water introducing valve 120 is opened to thereby introduce a new washing water into washing tank 100 which is suitable for rinsing the washing object. When the water introduction is finished, water introducing valve 120 is closed and motor 150 is driven to rotate rotary blade 110 for a predetermined time to generate a water stream suitable for rinsing the washing object ($S_{17}$).

The water stream necessary for the rinsing step is generated in the same manner as in the washing step. That is, rotary blade 110 rotates in the right direction for about 2–4 seconds, is stationary for about 5–6 seconds, rotates in the left direction for about 2–4 seconds and then is stationary for about 5–6 seconds, which as one cycle is repeated continuously for about two minutes.

This rinsing step is performed twice so that all the contaminants (stains and detergent) remaining on the washing object are removed.

When the rinsing step is completed, micom 200 sends a water drain order signal to driving part 160 to open water drain valve 130. Then the washing water remaining in washing tank 100 is drained, and a dewatering step starts. In the dewatering step, micom 200 combines rotary blade 100 with washing tank 100 mechanically and then drives motor 150 to rotates washing tank at a rotation speed of about 100 to 150 r.p.m. ($S_{18}$).

The dewatering step is performed by rotating washing tank 100 in the left or right for about 3–5 seconds, stilling washing tank 100 for about 5–6 seconds, repeating about seven times a process comprising the steps of i)rotating washing tank 100 in the left or right for about 2–3 seconds and ii)stilling washing tank 100 for about 5–6 seconds, and then rotating washing tank 100 in the left or right for about 1–3 seconds.

When the dewatering step is completed to finish the washing of the washing object, micom 200 generates a buzzer sound via speaker 190 so that the user may note that. This finishes the washing method for washing the washing object made of wool.

Embodiment 3

The present embodiment illustrate a washing method for washing a washing object made of a silk.

A detergent suitable for silk is introduced in an amount suitable for washing the laundry ($S_1$) and then a button for selecting a silk mode in key array part 170 is pushed ($S_2$). When micom 200 receives the signal for selecting the silk mode from key array part 170, a method for performing a silk washing course is performed to wash the laundry made of silk.

More particularly, in a selecting step of the washing mode, key array part 170 sends a silk mode selection signal to micom 200 ($S_3$), which judges whether the water level reaches the first level ($S_5$) and sends a water introducing order signal to driving part 160 to open water introducing valve 120. Then, washing water is introduced into washing tank 100 in a small amount through water introducing pipe ($S_6$).

When the suitable amount of water for diluting the detergent is introduced, micom 200 drives motor 150 via driving part 160 for a predetermined time, to thereby rotate rotary blade 110 at a low rotation speed. Due to the rotation of rotary blade 110, a water stream is generated to dilute the detergent ($S_8$). Simultaneously, a predetermined amount of water is sequentially introduced into washing tank 100.

When the suitable amount of water (at this time, the concentration of the detergent is about 0.5 g/l) is introduced into washing tank and the dilution of the detergent is completed, sensor 140 senses a water level enough for performing the washing step of the washing object and sends a signal to micom 200 ($S_7$). Then, micom 200 sends a water introducing stop order signal and a motor rotation stop order signal to driving part 160. Driving part 160 closes water introducing valve 120 in accordance with the water introducing stop order signal and stops motor 150 so that rotary blade 100 does not rotate any more ($S_9$). Also, micom 200 judges that the washing mode is a silk mode ($S_{10}$) and sends a display signal to display part 180 so that display part 180 displays "silk" ($S_{12}$) and sends a buzzer sound generating signal to speaker 190 to generate a buzzer sound on speaker 190 ($S_{13}$). When the user hears the buzzer sound, he introduces the laundry made of silk into washing tank 100 and then pushes a start button in key array part 170. Micom 200 judges whether the start signal is inputted from key array part 170. When micom 200 senses the start signal ($S_{14}$), a signal for performing the washing step is transmitted to driving part 160 to start the silk washing course. Within one minute, when the start signal is not inputted in micom 200 from key array part 170, micom 200 sends a buzzer sound generating Signal to speaker 190 again to generate another buzzer sound ($S_{15}$).

At the state that the washing object is in washing tank 100, when the start signal is applied, driving part 160 drives motor 150 so that rotary blade 110 rotates right and left for a predetermined time. More particularly, rotary blade 110 rotates in the right direction for about 0.3–0.5 seconds, is stationary for about 5–6 seconds, rotates the left direction for about 0.3–0.5 seconds and then is stationary for about 5–6 seconds, which as one cycle is repeated for a predetermined time (for example, about four minutes) to wash the washing object ($S_{16}$).

The washing object made of silk does not sink into the washing water but floats at an upper portion of the washing water. In the conventional washing machine, the rotating water stream is generated regardless of the kinds of the fabrics of the washing objects. In this case, when the rotating water is generated for a long time, the washing object sinks due to the rotating water stream to come in contact with rotary blade 110 or with the bottom portion of washing tank 100. Therefore, the washing object is damaged. However, in the present embodiment, rotary blade is rotated for about 0.3 to 0.5 seconds. Then, the washing object sinks to the lower portion of the washing water and is washed due to the rotation friction force. However, since the water stream is generated for a short time, the washing object does not come in contact with rotary blade 110 or the bottom of washing tank 100 although the washing object sinks into the washing water. Therefore, the washing object is not damaged.

After rotating rotary blade 110 for about 0.3–0.5 seconds, rotary blade 110 is stationary for about 5–6 seconds. At this time, the pressure generated by the rotating water stream is reduced and the washing object which has sunk due to the rotating water stream rises to the surfaces of the washing water.

At this state, rotary blade 110 rotates in the opposing direction to generate a rotating water stream again. Then, the washing object sinks again and is washed due to the rotating friction force of the water stream.

When the washing step is completed, micom 200 sends a water drain order signal to driving part 160, which opens water drain valve 130 to drain the washing water from washing tank 100 through a drain hose.

When the water draining is completed, micom 200 sends a water introducing order signal to driving part 160. Then, water drain valve 130 is closed and water introducing valve 120 is opened to thereby introduce a new washing water into washing tank 100 which is suitable for rinsing the washing object. When the water introduction is finished, water introducing valve 120 is closed and motor 150 is driven to rotate rotary blade 110 for a predetermined time to generate a water stream suitable for rinsing the washing object. The water stream necessary for the rinsing step is generated in the same manner as in the Washing step. That is, rotary blade 110 rotates in the right direction for about 0.3–0.5 seconds, is stationary for about 5–6 seconds, rotates in the left direction for about 0.3–0.5 seconds and then is stationary for about 5–6 seconds, which as one cycle is repeated continuously for about two minutes ($S_{17}$).

This rinsing step is performed twice so that all the contaminants (stains and detergent) remaining on the washing object are removed.

When the rinsing step is completed, micom 200 sends a water drain order signal to driving part 160 to open water drain valve 130. Then the Washing water remaining in washing tank 100 is drained, and a dewatering step starts.

In the dewatering step, micom 200 combines rotary blade 100 with washing tank 100 mechanically and then drives motor 150 to rotate washing tank at a rotation speed of about 100 to 150 r.p.m.

The dewatering step is performed by rotating washing tank 100 in the left or right for about 3–5 seconds, stilling washing tank 100 for about 5–6 seconds, repeating about seven times a process comprising the steps of i)rotating washing tank 100 in the left or right for about 2–3 seconds and ii)stilling washing tank 100 for about 5–6 seconds, and then rotating washing tank 100 in the left or right for about 1–3 seconds ($S_{18}$)

When the dewatering step is completed to finish the washing of the washing object, micom 200 generate a buzzer sound via speaker 190 so that the user may note that. This finishes the washing method for washing the washing object made of silk.

In accordance with a method described in embodiment 1, a washing object made of cottons or a synthetic fiber has been washed. As a washing machine, DWF-9290RD (trade name by Daewoo Electronics Co. Ltd.) wherein the method of the present invention is embodied was used. As a detergent, a standard detergent for investigating the washing capability of a washing machine was used. The detergent was used in an amount of 2 g per liter of water.

Additionally, using a conventional washing machine wherein the conventional washing method is embodied, a conventional general washing method has been carried out under the same conditions. The washability and dewatering have been measured against the washing objects which had been washed by using a washing machine of the present invention and a conventional washing machine. The results are shown in table 1 as below.

TABLE 1

| | Embodiment 1 | Conventional Method |
|---|---|---|
| washability | 113 | 100 |
| dewatering | 102 | 100 |

As can be seen from table 1, it can be noted that the washability of the washing object according to the present invention is superior to that of a conventional method, while the dewatering degrees are similar with each other.

In accordance with the methods described in embodiments 2 and 3, washing objects made of a wool and a silk has been washed. As a washing machine, DWF-9290RD (trade name by Daewoo Electronics Co. Ltd., Korea) wherein the method of the present invention is embodied was used. As a detergent, Dryten (trade name by Hichem Co., Korea) was used. The detergent was used in an amount of 0.5 g per liter of water.

Additionally, using a conventional washing machine which is used in a laundry shop wherein a conventional washing method is embodied, a conventional detergent for washing the objects made of a wool and a silk and a conventional solvent comprised of perchloroethylene, a dry cleaning of the washing object has been carried out. The shrinkage and the fabric damage have been measured against the washing objects which had been washed by the method of the present invention and a conventional dry cleaning method.

The measuring methods are as follows.

1) After washing test pieces of fabrics (silk and wool) as a washing object four times, the lengths of the test pieces have been measured. The shrinkage was calculated by the following equation (1).

$$\text{shrinkage (\%)} = \frac{\text{length before washing} - \text{length after washing}}{\text{length before washing}} \times 100 \quad (1)$$

2) After washing test pieces of fabrics (silk and wool) as a washing object twenty times, the weights of the test pieces have been measured. The damage degree was calculated by the following equation (2).

$$\text{damage (\%)} = \frac{\text{weight before washing} - \text{weight after washing}}{\text{weight before washing}} \times 100 \quad (2)$$

The measured shrinkage and damage degrees are shown in table 2 as below.

TABLE 2

| | Embodiment 2 | Embodiment 3 | Conventional (wool) | Conventional (silk) |
|---|---|---|---|---|
| shrinkage (%) | | | | |
| 1) | 1.09 | 1.51 | 1.33 | 2.73 |
| 2) | 0.81 | 0.37 | 0.65 | 1.42 |
| damage (%) | 0.58 | 0.45 | 3.58 | 3.58 |

Note.
1) measured in a lengthwise direction of the test fabric pieces
2) measured in a crosswise direction of the test fabric pieces As can be seen from table 2 above, when performing a washing method of the present invention for wool and silk, the shrinkage and damage are similar with those in the conventional method in a laundry shop. This indicates that washing a washing object made of wool or silk can be easily performed according to the method of the present invention.

In accordance with the present invention, washing a washing object made of pure wool or silk can be easily performed at home without any damages to the washing object. Therefore, economic costs which may occur by entrusting the laundry to the laundry shop may be reduced. Further, the impression that the laundry is unsanitary since many washing objects from the different persons are washed simultaneously in the laundry shop, may be avoided. Therefore, one may wear clothes with a clear and comfortable mind.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A method for washing a washing object comprising the steps of:

introducing a detergent into a washing tank equipped with a rotary blade for generating a water stream;

introducing a first amount of water into said washing tank;

introducing additional water into said washing tank while generating a first water stream in said first amount of water by driving said rotary blade, so that said detergent is diluted in said first amount of water and that said washing tank is filled with a second amount of water suitable for washing said washing object, the second amount of water containing the detergent;

introducing the washing object into the washing tank with the second amount of water; and washing the washing object by rotating the rotary blade for generating a second water stream suitable for washing the washing object.

2. The method as claimed in claim 1, after said washing step, said method further comprising a step of rinsing said washing object by performing a rinsing process at least once, said rinsing process comprising the steps of:

a) draining a remaining water from the washing tank after said washing step or after a previous rinsing step;

b) introducing a third amount of water suitable for rinsing said washing object into said washing tank; and c) rinsing said washing object by generating a third water stream suitable for rinsing said washing object.

3. The method as claimed in claim 2, wherein said rinsing process is performed twice.

4. The method as claimed in claim 2, after said rinsing step, said method further comprising the steps of:

draining a remaining water from the washing tank after said rinsing step; and dewatering a remaining water absorbed in said washing object by rotating said washing tank after said draining step.

5. The method as claimed in claim 4, wherein said washing object is comprised of a wool.

6. The method as claimed in claim 5, wherein said washing step is performed by carrying out a washing process at least once, said washing process comprising the steps of:

a) rotating said rotary blade in a first direction for about 2–4 seconds;

b) stilling said rotary blade for about 5–6 seconds after said step a);

c) rotating said rotary blade in a second direction opposing to said first direction for about 2–4 seconds after said step b); and d) stilling said rotary blade for about 5–6 seconds after said step c).

7. The method as claimed in claim 5, wherein said rinsing step is performed by carrying out a rinsing process at least once, said rinsing process comprising the steps of:

a) rotating said rotary blade in a first direction for about 2–4 seconds;

b) stilling said rotary blade for about 5–6 seconds after said step a);

c) rotating said rotary blade in a second direction opposing to said first direction for about 2–4 seconds after said step b); and d) stilling said rotary blade for about 5–6 seconds after said step c).

8. The method as claimed in claim 5, wherein said dewatering step is performed by carrying out the steps of:

a) rotating said washing tank in a first direction for about 3–5 seconds;

b) stilling said washing tank for about 5–6 seconds after said step a);

c) repeating at least once a process comprising the steps of i) rotating said washing tank in a first direction for about 2–3 seconds and ii) stilling said washing tank for about 5–6 seconds, after said step b); and d) rotating said washing tank in a first direction for about 2 seconds after said step c).

9. The method as claimed in claim 4, wherein said washing object is comprised of a silk.

10. The method as claimed in claim 9, wherein said washing step is performed by carrying out a washing process at least once, said washing process comprising the steps of:

a) rotating said rotary blade in a first direction for about 0.3–0.5 seconds;

b) stilling said rotary blade for about 5–6 seconds after said step a);

c) rotating said rotary blade in a second direction opposing to said first direction for about 0.3–0.5 seconds after said step b); and d) stilling said rotary blade for about 5–6 seconds after said step c).

11. The method as claimed in claim 9, wherein said rinsing step is performed by carrying out a rinsing process at least once, said rinsing process comprising the steps of:

a) rotating said rotary blade in a first direction for about 0.3–0.5 seconds;

b) stilling said rotary blade for about 5–6 seconds after said step a);

c) rotating said rotary blade in a second direction opposing to said first direction for about 0.3–0.5 seconds after said step b); and d) stilling said rotary blade for about 5–6 seconds after said step c).

12. The method as claimed in claim 9, wherein said dewatering step is performed by carrying out the steps of:

a) rotating said washing tank in a first direction for about 3–5 seconds;

b) stilling said washing tank for about 5–6 seconds after said step a);

c) repeating at least once a process comprising the steps of i) rotating said washing tank in a first direction for about 2–3 seconds and ii) stilling said washing tank for about 5–6 seconds, after said step b); and d) rotating said washing tank in a first direction for about 2 seconds after said step c).

13. The method as claimed in claim 1, wherein said method further comprising a step of generating a sound after introducing said second amount of water into said washing tank.

14. A method for washing a washing object comprising the steps of:

introducing a detergent into a washing tank equipped with a rotary blade for generating a water stream;

introducing a first amount of water into said washing tank;

introducing additional water into said washing tank while generating a first water stream in said first amount of water by driving said rotary blade, so that said detergent is diluted in said first amount of water and that said washing tank is filled with a second amount of water suitable for washing said washing object, the second amount of water containing the detergent;

generating a sound after introducing said second amount of water into said washing tank;

introducing the washing object into the washing tank with the second amount of water;

washing the washing object by rotating the rotary blade for generating a second water stream suitable for washing the washing object;

rinsing said washing object by performing a rinsing process at least once, said rinsing process comprising the steps of: a) draining a remaining water from the washing tank after said washing step or after a previous rinsing step; b) introducing a third amount of water suitable for rinsing said washing object into said washing tank; and c) rinsing said washing object by generating a third water stream suitable for rinsing said washing object;

draining a remaining water from the washing tank after said rinsing step; and dewatering a remaining water absorbed in said washing object by rotating said washing tank after said draining step.

15. The method as claimed in claim 14, wherein said washing object is comprised of a wool and said washing step is performed by carrying out a washing process at least once, said washing process comprising the steps of:

a1) rotating said rotary blade in a first direction for about 2–4 seconds;

b1) stilling said rotary blade for about 5–6 seconds after said step a1);

c1) rotating said rotary blade in a second direction opposing to said first direction for about 2–4 seconds after said step b1); and d1) stilling said rotary blade for about 5–6 seconds after said step c1).

16. The method as claimed in claim 15, wherein said rinsing step is performed by carrying out a rinsing process at least once, said rinsing process comprising the steps of:

a2) rotating said rotary blade in a first direction for about 2–4 seconds;

b2) stilling said rotary blade for about 5–6 seconds after said step a2);

c2) rotating said rotary blade in a second direction opposing to said first direction for about 2–4 seconds after said step b2); and d2) stilling said rotary blade for about 5–6 seconds after said step c2).

17. The method as claimed in claim 15, wherein said dewatering step is performed by carrying out the steps of:

a3) rotating said washing tank in a first direction for about 3–5 seconds;

b3) stilling said washing tank for about 5–6 seconds after said step a3);

c3) repeating at least once a process comprising the steps of i) rotating said washing tank in a first direction for about 2–3 seconds and ii) stilling said washing tank for about 5–6 seconds, after said step b3); and d3) rotating said washing tank in a first direction for about 2 seconds after said step c3).

18. The method as claimed in claim 14, wherein said washing object is comprised of a silk and said washing step is performed by carrying out a washing process at least once, said washing process comprising the steps of:

a4) rotating said rotary blade in a first direction for about 0.3–0.5 seconds;

b4) stilling said rotary blade for about 5–6 seconds after said step a4);

c4) rotating said rotary blade in a second direction opposing to said first direction for about 0.3–0.5 seconds after said step b4); and d4) stilling said rotary blade for about 5–6 seconds after said step c4).

19. The method as claimed in claim 18, wherein said rinsing step is performed by carrying out a rinsing process at least once, said rinsing process comprising the steps of:

a5) rotating said rotary blade in a first direction for about 0.3–0.5 seconds;

b5) stilling said rotary blade for about 5–6 seconds after said step a5);

c5) rotating said rotary blade in a second direction opposing to said first direction for about 0.3–0.5 seconds after said step b5); and d5) stilling said rotary blade for about 5–6 seconds after said step c5).

20. The method as claimed in claim 18, wherein said dewatering step is performed by carrying out the steps of:

a6) rotating said washing tank in a first direction for about 3–5 seconds;

b6) stilling said washing tank for about 5–6 seconds after said step a6);

c6) repeating at least once a process comprising the steps of i) rotating said washing tank in a first direction for about 2–3 seconds and ii) stilling said washing tank for about 5–6 seconds, after said step b6); and d6) rotating said washing tank in a first direction for about 2 seconds after said step c6).

* * * * *